US009274495B2

(12) United States Patent
Ninomiya

(10) Patent No.: US 9,274,495 B2
(45) Date of Patent: Mar. 1, 2016

(54) IMAGE FORMING APPARATUS HAVING FIXING UNIT WHOSE PROJECTED PORTION IS PREVENTED FROM COMING OUT OF MAIN ASSEMBLY OPENING AFTER ENTERING MAIN ASSEMBLY RECESSED PORTION

(71) Applicant: CANON KABUSHIKI KAISHA, Tokyo (JP)

(72) Inventor: Kenji Ninomiya, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/669,282

(22) Filed: Mar. 26, 2015

(65) Prior Publication Data

US 2015/0277364 A1 Oct. 1, 2015

(30) Foreign Application Priority Data

Mar. 28, 2014 (JP) ..... 2014-068578

(51) Int. Cl.
*G03G 21/16* (2006.01)
*G03G 15/20* (2006.01)

(52) U.S. Cl.
CPC .... *G03G 21/1685* (2013.01); *G03G 2221/1639* (2013.01)

(58) Field of Classification Search
CPC ..... G03G 21/1685; G03G 2221/1639
USPC ..... 399/122
See application file for complete search history.

(56) References Cited

U.S. PATENT DOCUMENTS

| | | | | |
|---|---|---|---|---|
| 2009/0010680 | A1* | 1/2009 | Nanno | 399/122 |
| 2011/0182031 | A1* | 7/2011 | Ohnishi | 399/122 X |
| 2014/0153965 | A1* | 6/2014 | Nanno | 399/122 |

FOREIGN PATENT DOCUMENTS

| | | | |
|---|---|---|---|
| JP | H11-212428 | A | 8/1998 |
| JP | 2000-356938 | A | 12/2000 |
| JP | 2009-251347 | A | 10/2009 |

* cited by examiner

*Primary Examiner* — Sophia S Chen
(74) *Attorney, Agent, or Firm* — Fitzpatrick, Cella, Harper & Scinto

(57) ABSTRACT

An image forming apparatus includes: a main assembly; and a fixing unit for fixing an image on a recording material. The fixing unit is detachably mountable to the main assembly. The fixing unit includes a projected portion for regulating a position of the fixing unit relative to the main assembly. The main assembly includes an opening for guiding movement of the projected portion and a recessed portion, provided downstream of the opening with respect to a mounting direction of the fixing unit, for regulating a position of the projected portion. The fixing unit includes an engaging portion engaging with the opening so that the projected portion is prevented from coming out of the opening after entering the recessed portion.

6 Claims, 8 Drawing Sheets

IMAGE FORMING APPARATUS HAVING FIXING UNIT WHOSE PROJECTED PORTION IS PREVENTED FROM COMING OUT OF MAIN ASSEMBLY OPENING AFTER ENTERING MAIN ASSEMBLY RECESSED PORTION

FIELD OF THE INVENTION AND RELATED ART

The present invention relates to an image forming apparatus such as a printer, a copying machine or a facsimile machine.

As a fixing unit (fixing device) mounted in the image forming apparatus such as the printer, the copying machine or the facsimile machine, e.g., a fixing device of a heating roller type has been known. The fixing device of this type includes a fixing roller, a heater for heating the fixing roller, and a pressing roller for forming a fixing nip in combination with the fixing roller, and the like. Further, a recording material carrying thereon an unfixed toner image is heated while being nipped and fed at the fixing nip of the fixing device, and the toner image on the recording material is fixed on the recording material.

The fixing unit is required to exchange the fixing roller and the pressing roller in order to maintain an image quality when the operation time and the print number exceed a certain amount. For that purpose, a constitution in which the fixing unit is made detachably mountable to an image forming apparatus main assembly (apparatus main assembly) to facilitate exchange (replacement) has been known.

Japanese Laid-Open Patent Application (JP-A) Hei 11-212428 discloses a constitution in which a shaft provided on a fixing unit is mounted in a U-shaped groove provided in an apparatus main assembly and an opening of the U-shaped groove is closed by a member separately provided in the apparatus main assembly to hold the fixing unit.

JP-A 2009-251347 employs a constitution in which a shaft provided on a fixing unit is mounted in a U-shaped groove provided in an apparatus main assembly and is pressed by a spring (member) provided in the apparatus main assembly.

In the case where the shaft of the fixing unit is pressed by the spring, there is a need to increase the spring force in order to prevent the fixing unit from disengaging from the apparatus main assembly even when vibration and shock (impact) during transportation or the like are exerted on the fixing unit. However, when the fixing unit is mounted, there is a need to press the fixing unit into the apparatus main assembly with a force stronger than the spring force, so that operability is impaired.

SUMMARY OF THE INVENTION

The present invention has been developed in view of the above-described problem. A principal object of the present invention is to provide an image forming apparatus which improves operability when a fixing unit is mounted in and demounted from a main assembly of the image forming apparatus and even when a shock is exerted on the unit, the fixing unit is not readily disengaged from the main assembly.

According to an aspect of the present invention, there is provided an image forming apparatus comprising: a main assembly; and a fixing unit for fixing an image on a recording material. The fixing unit is detachably mountable to the main assembly. The fixing unit includes a projected portion for regulating a position of the fixing unit relative to the main assembly. The main assembly includes an opening for guiding movement of the projected portion and a recessed portion, provided downstream of the opening with respect to a mounting direction of the fixing unit, for regulating a position of the projected portion. The fixing unit includes an engaging portion engaging with the opening so that the projected portion is prevented from coming out of the opening after entering the recessed portion.

These and other objects, features and advantages of the present invention will become more apparent upon a consideration of the following description of the preferred embodiments of the present invention taken in conjunction with the accompanying drawings.

DESCRIPTION OF THE DRAWINGS

Embodiments of the present invention will be specifically described with reference to the drawings.

First Embodiment

Image Forming Apparatus

Figure 8:
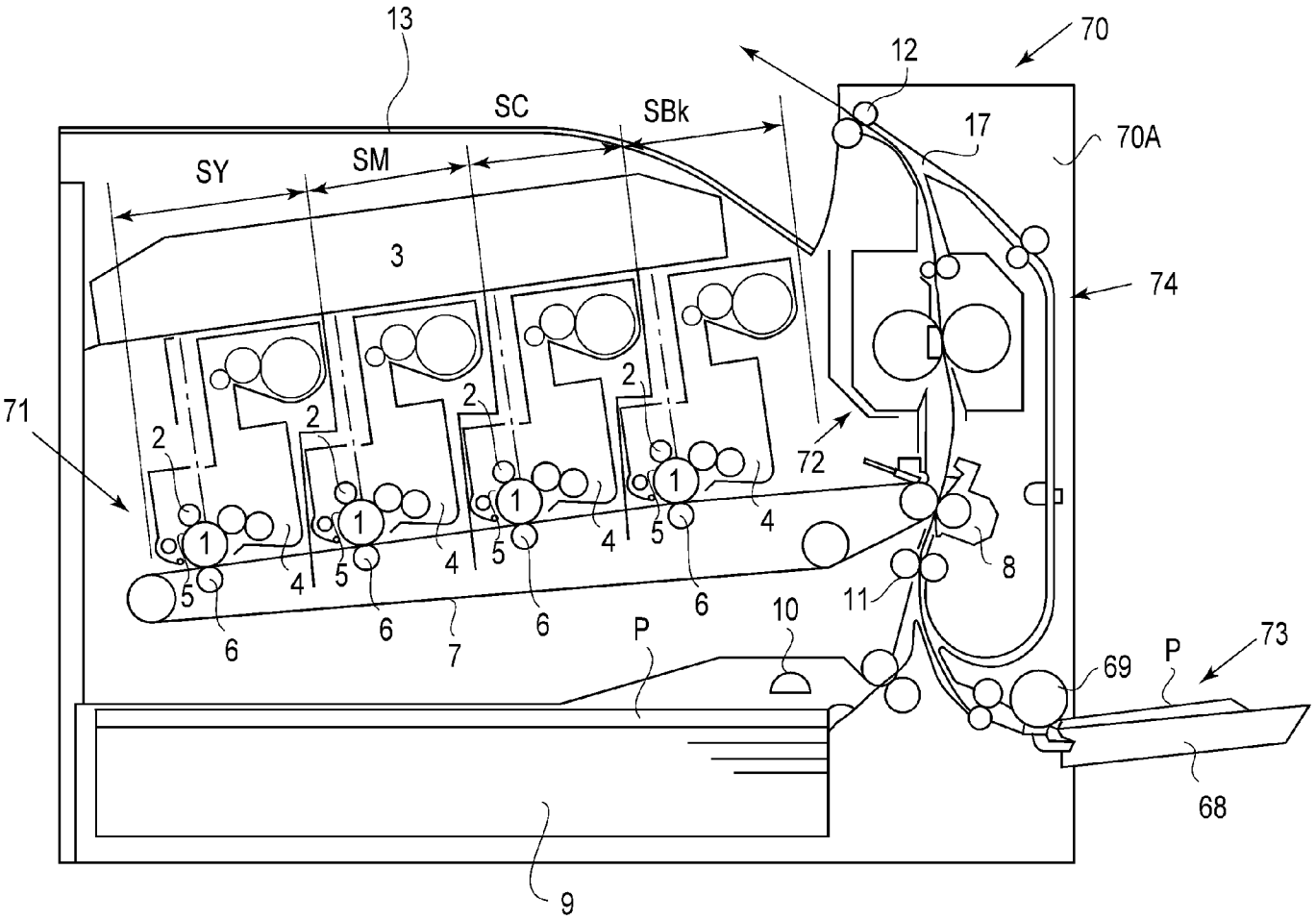
FIG. 8 is a sectional view showing a general structure of an image forming apparatus in the First Embodiment.

FIG. 8 is a sectional view showing a general structure of an example of an image forming apparatus (a full-color printer in this embodiment) using electrophotographic recording technology. In an image forming apparatus 70, a fixing unit 72, described later, is detachably mountable to an apparatus main assembly 70A.

In the image forming apparatus 70, an image forming portion 71 includes four image forming stations SY, SM, SC and SBk for yellow, magenta, cyan and black, respectively. Each of the image forming stations includes a photosensitive drum 1, a charging member 2, a laser scanner 3, a developing device 4 and a cleaner 5 for cleaning the photosensitive drum 1.

Further, each of the image forming stations includes a transfer member 6, a belt 7 for feeding a toner image transferred from the photosensitive member 1 by the transfer member 6 while carrying thereon the toner image, a secondary transfer member 8 for transferring the toner image from the belt 7 onto the recording material P, and the like. The position of the image forming portion 71 is well known, and therefore a detailed description thereof is omitted.

In each of the image forming stations, the photosensitive drum 1, the charging member 2, the developing device 4 and the cleaner 5 are integrally assembled into a cartridge (unit) detachably mountable to an image forming apparatus main assembly (apparatus main assembly) 70A.

The recording material P accommodated in a cassette 9 in the apparatus main assembly 70A is fed one by one by rotation of a roller 10. Then, the recording material P is fed by rotation of a roller pair 11 to a secondary transfer nip formed by the belt 7 and the secondary transfer member 8. The recording material P on which the toner image is transferred at the secondary transfer nip is sent into a fixing portion (fixing unit) 72, and the toner image is heat-fixed on the recording material P in the fixing portion. The recording material P coming out of the fixing unit 72 is fed by rotation of a roller pair 12 to a discharge portion 13 via a sheet guide 17, thus being discharged on the discharge portion 13.

A recording material feeding portion (recording material feeding device) 73 mounted on the apparatus main assembly 70A is constituted so that the recording material P stacked on a tray unit 68 is fed one by one by a feeding roller unit 69. The recording material P fed by the feeding roller unit 69 is fed to the secondary transfer nip by rotation of the roller pair 11, so that toner image is transferred onto the recording material P. The recording material P on which the toner image is heat-fixed by the fixing unit 72 is fed by rotation of the roller pair 12 and is discharged on the discharge portion 13.

A feeding portion 74 for double-side printing is used in the case where the toner image is formed on a second surface (back surface), as a printing surface, of the recording material P. At the feeding portion 74, a sensor (not shown) detects that a trailing end of the recording material P on which the toner image is formed on a first surface (front surface) as the printing surface and then the roller pair 12 is reversely rotated to switch back the recording material P and thus the recording material P is fed to the roller pair 11. The recording material P is fed to the secondary transfer nip by rotation of the roller pair 11, so that the toner image is transferred onto the second surface. The recording material P on which the toner image is heat-fixed on the second surface is fed by rotation of the roller pair 12 and is discharged on the discharge portion 13.

(Fixing Unit)

Figure 7A:
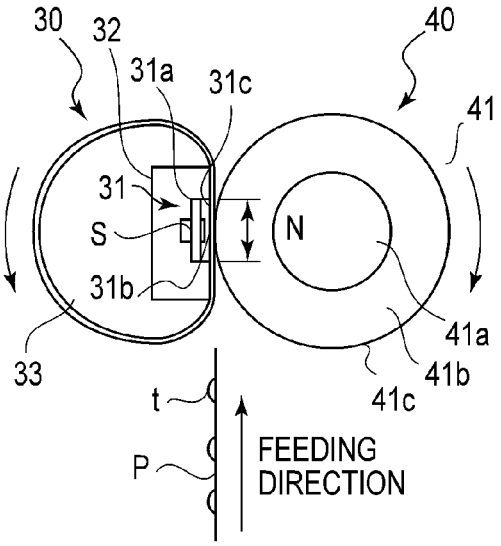
FIGS. 7A and 7B are schematic views of the fixing unit in the First Embodiment.
Figure 7B:
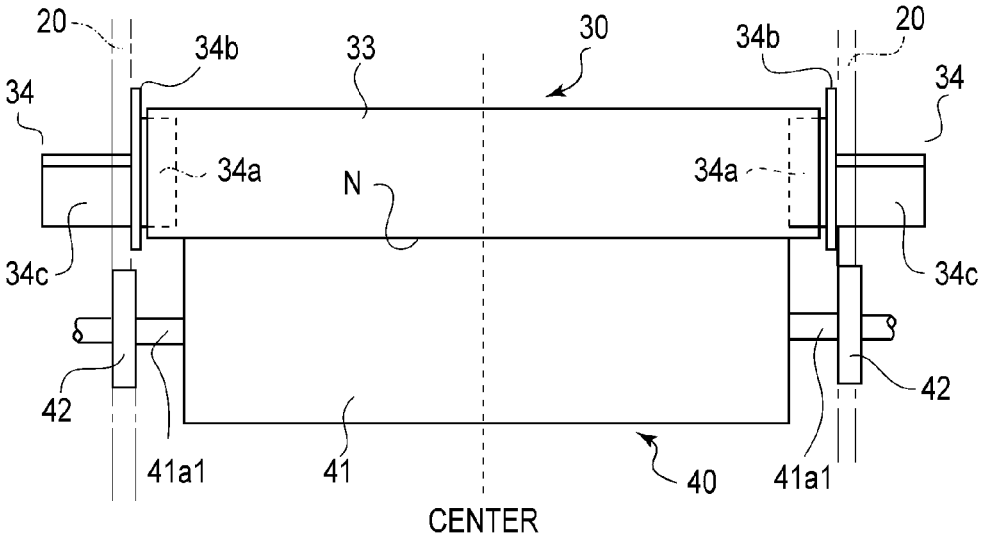

FIGS. 7A and 7B are schematic views showing a principal part of the fixing unit 72. FIG. 7A is a sectional view showing a general structure of the fixing unit 72, and FIG. 7B is a side view showing the general structure as seen from an upstream side of a recording material feeding direction. This fixing unit is a fixing device of a type in which an unfixed toner image t carried on the recording material P is heated by a sleeve 33.

The fixing unit 72 includes a heating unit 30, a pressing roller unit 40 and a frame 20 constituting a framework thereof, and each of the heating unit 30 and the pressing roller unit 40 is supported by the frame 20.

The heating unit 30 includes a heater 31 and a heater holder 32 for supporting the heater 31. Further, the heating unit 30 includes the sleeve (rotatable heating member) 33 as a first rotatable member loosely fitted around an outer peripheral surface of the heater holder 32 and a flange 34 provided at each of longitudinal end portions of the sleeve 33 (FIG. 7B). Each of the heater 31, the heater holder 32 and the sleeve 33 is a long member with respect to a direction (longitudinal direction) perpendicular to the recording material feeding direction.

The heater 31 includes an elongated substrate 31*a* formed of ceramics, a heat generating resistor 31*b*, formed on the substrate 31*a*, for generating heat by energization, and a protective layer 31*c* for covering and protecting the heat generating resistor 31*b* (FIG. 7A). The flange 34 includes a guiding portion 34*a* for guiding a rotation locus of the sleeve 33, a regulating portion (limiting portion) 34*b* for regulating (limiting) movement of the sleeve 33 in a thrust direction during a rotational operation of the sleeve 33, and a supporting portion 34*c* for supporting an associated longitudinal end portion of the heater holder 32.

The heating unit 30 is movably supported by the frame 20 at the supporting portion 34*c* of the flange 34 and is constituted so that the sleeve 33 can be pressed against a pressing roller 41, described later, of the pressing roller unit 40. The pressing roller unit 40 includes the pressing roller (rotatable pressing member) 41, a bearing 42 and a gear (not shown). The press roller 41 includes a metal core 41*a* having longitudinal end shaft portions 41*a*1, an elastic layer 41*b* formed of a silicone rubber or the like no an outer peripheral surface of the metal core 41*a* between the longitudinal end shaft portions 41*a*1, and a parting layer 41*c* coated on an outer peripheral surface of the elastic layer 41*b*.

The pressing roller unit 40 is provided on the frame 20 so that the outer peripheral surface of the pressing roller 41 thereof contacts the outer peripheral surface of the sleeve 33 of the heating unit 30. Further, the longitudinal end shaft portions 41*a*1 of the metal core 41*a* of the pressing roller 41 are rotatably supported by the frame 20 via the bearings 42, and on one of the shaft portions 41*a*1, a gear (not shown) is fixed.

The fixing unit 72 in this embodiment is constituted so that the sleeve 33 is pressed against the pressing roller 41 via the flanges 34 of the heating unit 30 in a direction perpendicular to a generatrix direction of the pressing roller 41. The flanges 34 are pressed, so that the heater 31 is pressed toward the pressing roller 41 via the sleeve 33. As a result, the elastic layer 41*b* of the pressing roller 41 is elastically deformed, so that a fixing nip N (FIG. 7A) having a predetermined width necessary to heat-fix the (unfixed) toner image is formed by a surface of the sleeve 33 and a surface of the pressing roller 41.

With reference to FIG. 7A, a heat-fixing operation will be described. A driving force of a motor (not shown) provided in the apparatus main assembly 70A is transmitted to a gear (not shown) of the pressing roller unit 40, so that the pressing roller 41 is rotationally driven in an arrow direction. The sleeve 33 is rotated in an arrow direction by the rotation of the pressing roller 41 while sliding with the heater 31 and the heater holder 32 at an inner peripheral surface (inner surface) of the sleeve 33.

To the heat generating resistor 31*b* of the heater 31, electric power is supplied from an energization control circuit (not shown), so that the heat generating resistor 31*b* generates heat, so that the heater increases in temperature. The energization control circuit controls the electric power supplied to the heater 31 so that a detection temperature of a temperature detecting element S for monitoring the temperature of the heater 31 is maintained at a fixing temperature (target temperature).

The toner image t is carried on the recording material P, and the heat of the heater 31 and the pressure of the fixing nip N are applied thereto while the recording material P is nipped and fed through the fixing nip N, so that the toner image is heat-fixed on the recording material.

Figure 1:
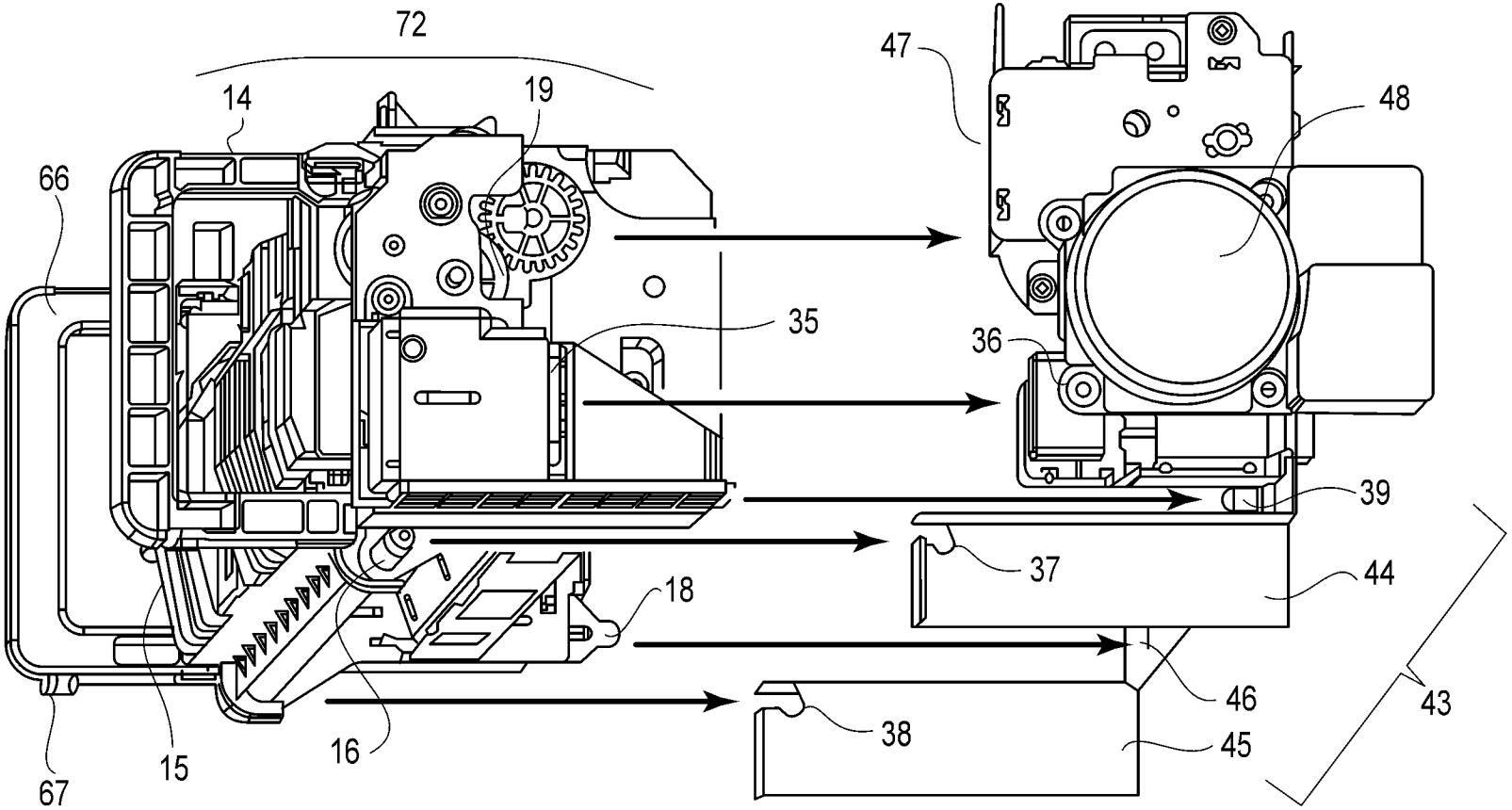
FIG. 1 is a perspective view showing a fixing unit before being mounted into an apparatus main assembly and a main assembly frame unit portion of the apparatus main assembly in which the fixing unit is mounted in the First Embodiment of the present invention.

FIG. 1 is a perspective view shown a main assembly frame unit 43 of the apparatus main assembly 70A for holding the fixing unit 72 and a state in which the fixing unit 72 is demounted from the apparatus main assembly 70A. The main assembly frame unit 43 of the apparatus main assembly 70A includes holes (recessed portions) 37 and 38, provided in front and rear side plates 44 and 45, respectively, in the figure, for holding the fixing unit 72. The fixing unit 72 includes a supporting shaft (projected portion) 16 extending in a sheet width direction (longitudinal direction of the fixing unit 72). In the case where the fixing unit 72 is mounted into the apparatus main assembly, the supporting shaft 16 is mounted in the holes 37 and 38 through an opening 56 (formed or defined by an upper regulating portion 54 and a lower regulating portion 55 shown in FIGS. 3A-3C), s that the position of the fixing unit 72 is regulated relative to the apparatus main assembly 70A.

The main assembly frame unit 43 of the apparatus main assembly 70A is provided with a rectangular hole 46 and a shaft portion 39. The fixing unit 72 is provided with a boss portion 18 engageable with the rectangular hole 46 and a hole (not shown) engageable with the shaft portion 39, and by engagement of these portions, the fixing unit 72 is prevented from inclining in the apparatus main assembly 70A. Further, the main assembly frame unit 43 includes a driving unit 47 including a motor 48 as a driving source, and the fixing unit 72 includes a gear 19 for transmitting a driving force from the motor 48 to the pressing roller 41. At a lower portion of the driving unit 47, a drawer connector 36 connectable with a drawer connector 35 is held by the fixing unit 72. By connection between the connectors 35 and 36, electric power and control signals can be transmitted from the apparatus main assembly 70A to the fixing unit 72.

The fixing unit 72 includes handles 14 and 66 for carrying the fixing unit 72. The handle 14 is provided with an engaging portion 15 engageable with the opening 56 leading to the hole 37. The handle 66 is provided with an engaging portion 67 engageable with the opening 56 leading to the hole 38. Further, the handle 14 is provided with boss portions 25 and 26. The boss portions 25 and 26 engage with two holes, respectively, provided in bent portions 23 and 24 of the frame of the fixing unit. By this structure, the handle 14 is rotatable (foldable) about the boss portions relative to the main assembly of the fixing unit. Also the handle 66 has the same constitution as the handles 14, and therefore a description thereof will be omitted.

Figure 2A:
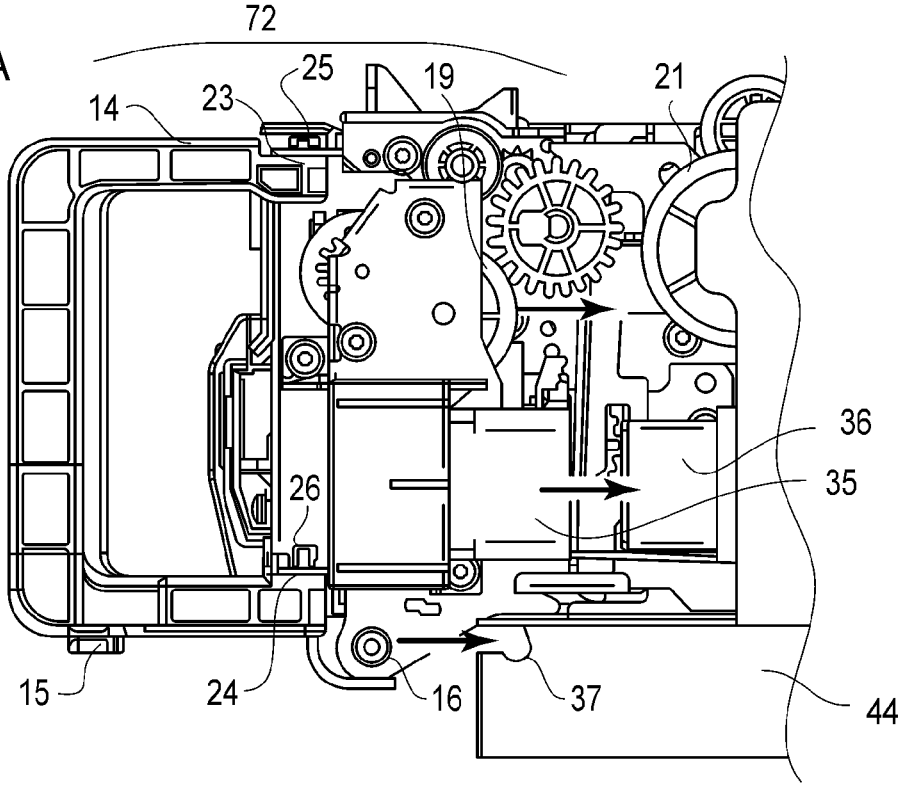
FIGS. 2A and 2B are side views showing states of a connecting portion before and after the fixing unit in the First Embodiment is mounted in the apparatus main assembly, respectively.
Figure 2B:
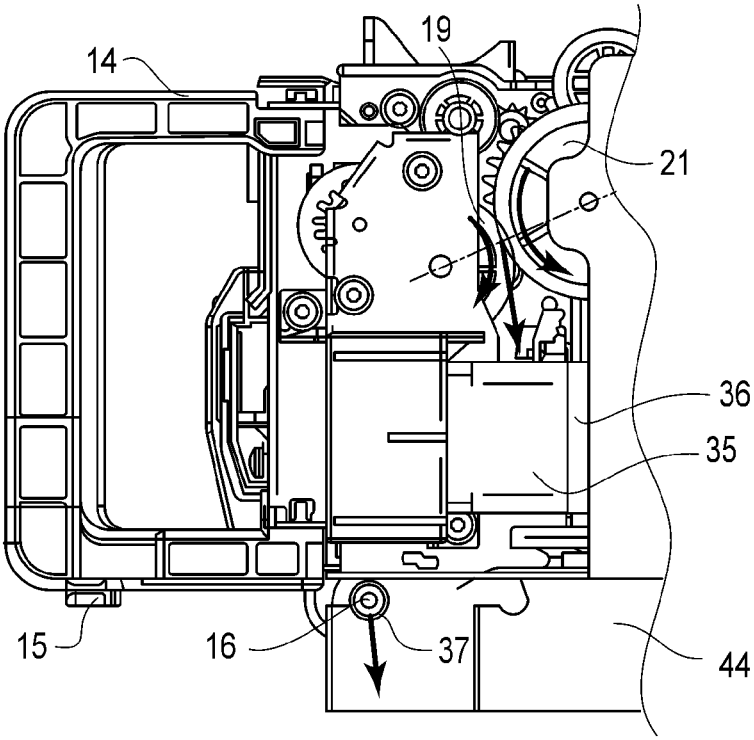

FIGS. 2A and 2B show states for illustrating a process of mounting the fixing unit 72 into the apparatus main assembly 70A. In these figures, parts in the driving units are omitted from illustration so that engagement between the gear 19 of the fixing unit and a gear 21 of the apparatus main assembly is understood. FIG. 2A shows the state immediately before the connection of the fixing unit with the side plate 44 of the apparatus main assembly, and FIG. 2B shows the state after the connection. The gear 21 rotates counterclockwise, and the gear 19 rotates clockwise. For that reason, when the driving force is transmitted from the apparatus main assembly to the fixing unit, to the supporting shaft 16, a force is applied downward as shown in FIG. 2B, but the force is received by the hole 37 of the apparatus main assembly.

When the fixing unit is mounted into the apparatus main assembly, as shown in FIGS. 2A and 2B, the two handles are raised relative to the main assembly of the fixing unit, and in this state, an operator grips the handles and then carries the fixing unit. When the fixing unit is mounted into the apparatus main assembly, the fixing unit is mounted so that the two supporting shafts (projected portions) 16 each projecting from the longitudinal end of the fixing unit can enter the openings leading to the holes (recessed portions) 37 and 38, respectively. After the fixing unit is mounted in the apparatus main assembly, the two handles are folded. When the handles are folded, the engaging portions 15 and 67 engage with the openings leading to the holes 37 and 38, respectively. Each of the engaging portions 15 and 67 has a function of preventing the associated supporting shaft 16 from coming out of the opening.

Figure 3A:
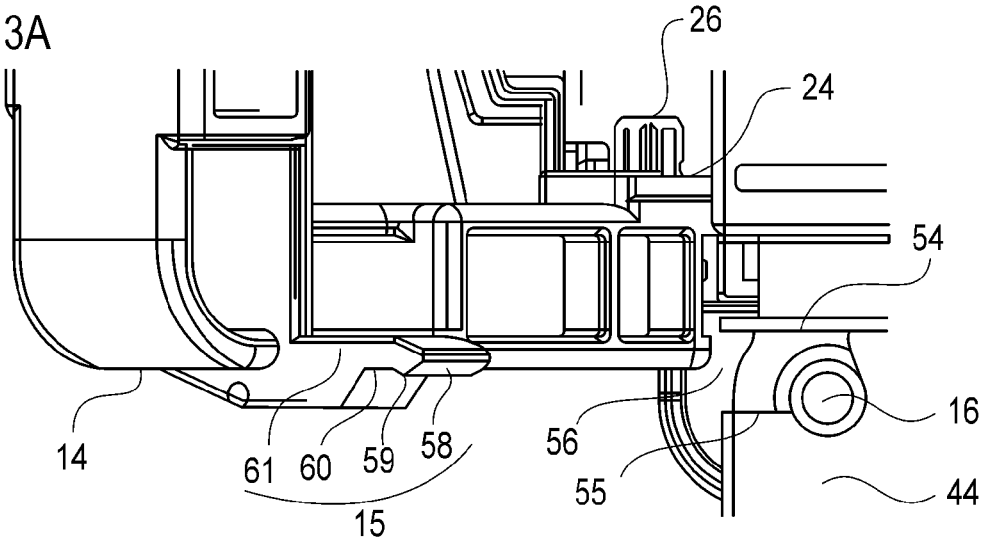
FIGS. 3A-3C are partly enlarged views for illustrating an operation from mounting of the fixing unit in the apparatus main assembly to fixing of the fixing unit in the apparatus main assembly in the First Embodiment.
Figure 3B:
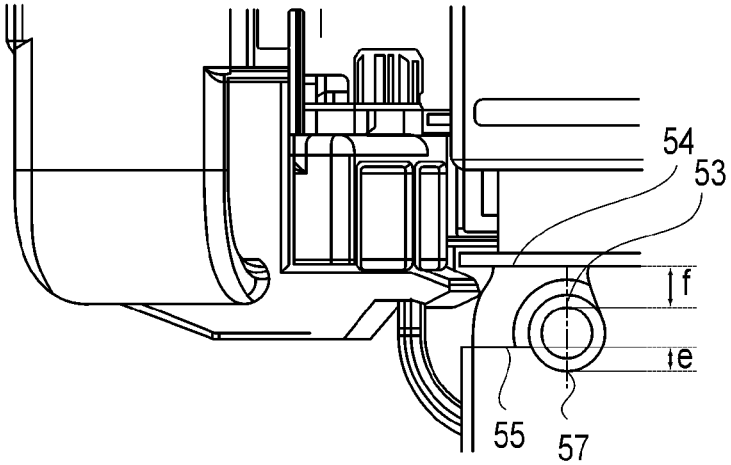
Figure 3C:
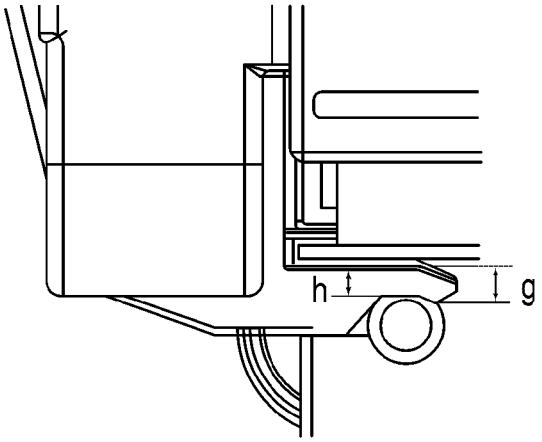

FIGS. 3A-3C are enlarged views showing the neighborhood of the hole 37 of the apparatus main assembly, the supporting shaft 16 of the fixing unit, and the engaging portion 15 of the fixing unit.

In the order of FIGS. 3A, 3B, and 3C, a change until the handle 14 is completely folded (i.e., a change until the engaging portion 15 is inserted into the hole 37 of the apparatus main assembly 70A). Also constitutions of the engaging portion 67 provided on the handle 66 and the hole 38 provided in the apparatus main assembly are the same as those in the handle 14 side, and therefore a description thereof will be omitted.

The engaging portion 15 includes, as shown in FIG. 3A, an inclined portion 58 at its free end portion, a projected portion 59 connected from the inclined portion 58, and a flat portion 60. Further, when the engaging portion 15 is inserted into the opening 56 (between the upper regulating portion 54 and the lower regulating portion 55 opposing the upper regulating portion 54), the inclined (free end) portion 58 contacts an upper surface of the supporting shaft 16 which has already been mounted in the hole (recessed portion) 37 provided in a rear side of the lower regulating portion 55. As a result, the engaging portion 15 can be easily mounted. After the mounting of the engaging portion 15, the projected portion 59 of the engaging portion 15 rides over the supporting shaft 16, so that return of the engaging portion 15 to a left side in the figure is limited, and thus a position of the handle 14 is fixed.

As in this embodiment, in the case where the hole 37 is provided in the rear side of the lower regulating portion 55, the distance from the lower regulating portion 55 to a bottom (the lowest point 57) of the supporting shaft 16 dropped in the round hole is taken as e, and the distance from the upper regulating portion 54 to a top portion (the highest point 53) of the supporting shaft 16 dropped in the round hole is taken as f. Further, the thickness (distance between an upper portion 61 and the projected portion 59) of the free end portion of the engaging portion inserted into the rear side where the inserted free end portion goes over the top portion (the highest point 53) is taken as g, and the thickness (distance between the upper portion 61 and the flat portion) of the engaging portion corresponding to the top potion of the supporting shaft is taken as h. At this time, the following formula (1) is satisfied.

$$h \leq g \leq f \text{ and } f-h<e \quad (1)$$

In this way, the thicknesses g and h of the engaging portion 15 are made not larger than f, which is the gap between the supporting shaft 16 and the upper regulating portion 54, so that the engaging portion 15 is insertable. Further, the drop-in amount (a stepped portion between the opening and the recessed portion) e of the supporting shaft 16 is made larger than (f−h), which is the gap between the supporting shaft 16 and the upper regulating portion 54 (gap between the projected portion and the opening) when the engaging portion 15 is inserted, so that disengagement (disconnection) of the supporting shaft 16 from the hole 37 is prevented.

In this embodiment, the return (displacement toward the left side in FIG. 3C) of the engaging portion 15 after the mounting is limited by satisfying h<g, but in the case of h=g, a mechanism for limiting the return of the engaging portion 15 after the mounting is separately provided. For example, a door for being opened and closed during mounting and demounting of the fixing unit is provided with a pressing mechanism for pressing the handle 14 when the door is closed.

Figure 4:
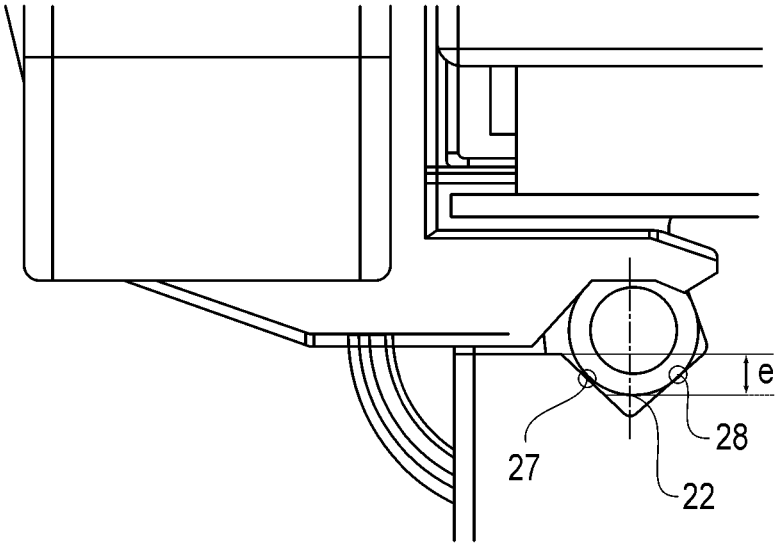
FIG. 4 is a partly enlarged view of a modified embodiment of the First Embodiment.

Further, as shown in FIG. 4, the hole (recessed portion), of the apparatus main assembly 70A, for holding the supporting shaft 16 of the fixing unit 72 may have a V-character shape having a cross section which has contacts 27 and 28 with the supporting shaft 16. The distance e in this case is the distance between the lower regulating portion 55 and a lowest end 22 of the supporting shaft 16.

As described above, the apparatus main assembly of the image forming apparatus includes the opening 56 for guiding the movement of the projected portion 16 of the fixing unit and the recessed portions 37 and 38, provided downstream of the opening 56 with respect to the fixing unit mounting direction, for regulating the position of the projected portion 16. Further, the fixing unit includes the engaging portions 15 and 67 engageable with the opening 56 so that the projected portion 16 is prevented from coming out of the opening 56 after entering the recessed portions 37 and 38. By this constitution, it is possible to provide an image forming apparatus which improves its operability when the fixing unit is mounted in and demounted from the image forming apparatus main assembly, and the fixing unit is not readily disengaged from the apparatus main assembly even when an impact is exerted on the fixing unit.

FIG. 5A to 5D are illustrates of the Second Embodiment. In this embodiment, a shape of an engaging portion provided on a handle is different from that in the First Embodiment. In the First Embodiment, suppression of the return such that the engaging portion comes out of the opening is effected using the difference in thickness between the inclined (free end) portion 58 and the projected portion 59 of the engaging portion 15, but in this embodiment, the suppression of the return after the mounting is effected using a contact-frictional force between a lower surface of an engaging portion 15' and a guiding member 65.

The image forming process of the image forming apparatus 70 and the fixing process of the fixing unit 72 are the same as those in the First Embodiment, and therefore a description thereof will be omitted. Portions similar to those in the First Embodiment are represented by the same reference numerals or symbols.

Figure 5A:
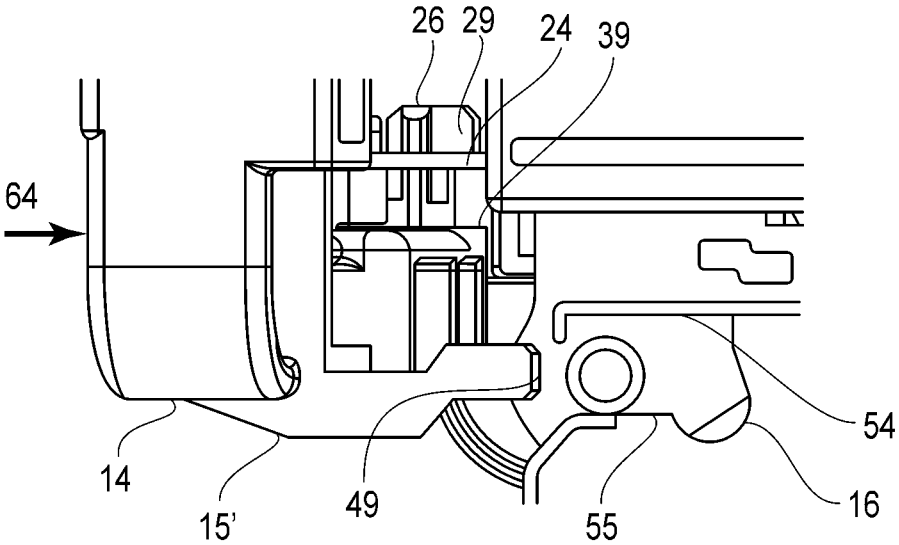
FIG. 5A to 5D are schematic views for illustrating mounting of a fixing unit into the apparatus main assembly in the Second Embodiment of the present invention.

FIG. 5A to 5D sequentially show a change from the disposition of the fixing unit 72 in the apparatus main assembly until the fixing unit 72 is mounted in the hole 37 for regulating the position of the fixing unit 72. FIG. 5A shows a state in which the supporting shaft 16 of the fixing unit 72 is placed on the lower regulating portion 55 for introducing the supporting shaft 16 into the hole 37 of the apparatus main assembly 70A, i.e., a state in which the fixing unit 72 is not inserted in a predetermined position of the apparatus main assembly.

The handle 14 for holding the fixing unit 72 penetrates through the hole of the bent portion 24 of the frame 20 and is held rotatably about the handle shaft portion 26 as a rotation center and movably in a vertical direction. The handle shaft portion 26 includes a lower abutment portion 29 for limiting downward movement of the handle by causing the fixing unit to hold the weight of the handle and an upper abutment portion 39 for limiting upward movement of the handle.

Figure 5B:
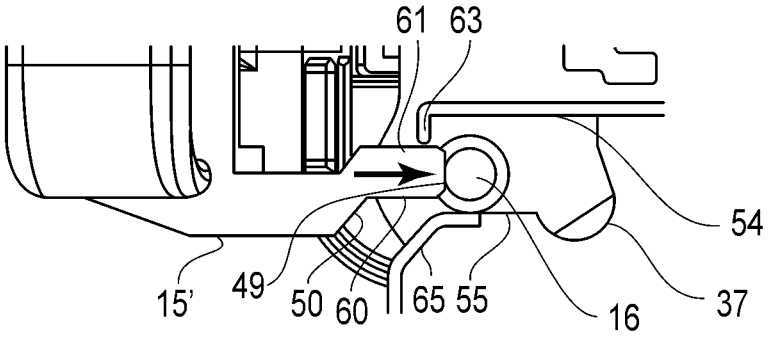

As shown by an arrow 64 in FIG. 5A, when the handle 14 is pushed during the mounting of the fixing unit, by the rotation of the handle 14, a free end portion 49 of the engaging portion 15' provided at a lower portion of the handle 14 approaches and abuts against the supporting shaft 16. This abutment state is shown in FIG. 5B. At this time, an upper surface 61 of the engaging portion 15' is positionally regulated by a free end 63 of the upper regulating portion provided on the side plate 44 of the apparatus main assembly, and therefore the free end portion 49 of the engaging portion 15' can be abutted against the supporting shaft 15 with accuracy.

Figure 5C:
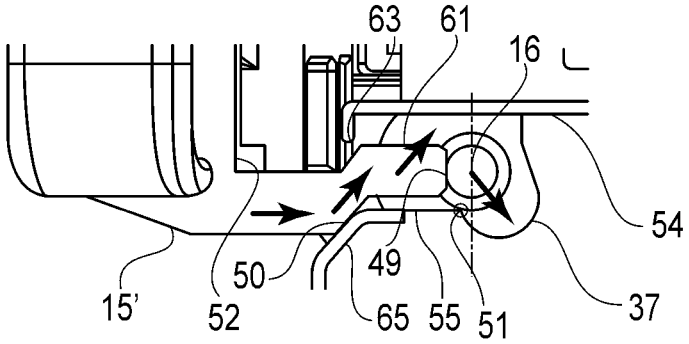

FIG. 5C shows a state in which the handle 14 is further pushed from the state of FIG. 5B and thus the fixing unit 72 is moved toward a mounting hole of the apparatus main assembly. In FIG. 5C, an inclined surface portion 50 positioned in a lower side of the engaging portion 15' abuts against the guiding member 65 of the side plate 44, but at this time, an upper-side portion 61 of the engaging portion 15' has already passed through the free end 63 of the upper regulating portion, and therefore the engaging portion 15' is in a state free from upward limitation (regulation).

For that reason, the engaging portion 15' is movable in an obliquely upper-right direction. Further, the center of the supporting shaft 16 has already passed through a terminal end 51 of the lower regulating portion 55 of the side plate 44, so that the movement direction of the shaft center of the supporting shaft 16 is oriented in a direction in which the supporting shaft 16 is dropped in the hole 37. Then, when the handle 14 is further pushed, the inclined surface portion 50 of the engaging portion 15 is guided obliquely rightward and upward by the guiding member 65, so that the engaging portion 15' moves together with the handle 14, while the supporting shaft 16 moves into the hole 37 positioned obliquely rightward and downward.

Figure 5D:
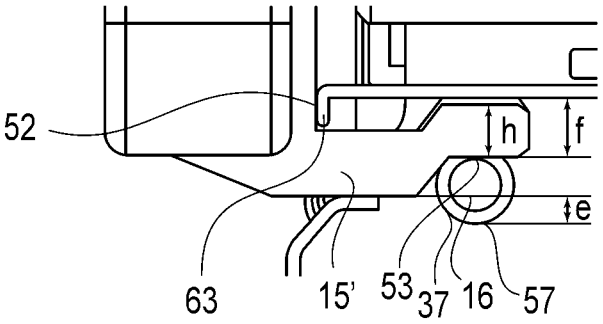

Thereafter, a base portion 52 of the engaging portion 15' abuts against the free end 63 of the upper regulating portion of the side plate 44, and thus the mounting of the fixing unit 72 in the apparatus main assembly 70A is completed (FIG. 5D). At this time, the distance from the lower regulating portion 55 to the lowest point 57 of the hole 37 is e, the distance between the upper regulating portion 54 and the upper end 53 of the supporting shaft 16 is f, and the thickness of the engaging portion 15' is h. In this case, similarly as in the case of the formula (1) in the First Embodiment, the following formula (2) is satisfied.

$$0 \leq f-h < e \quad (2)$$

That is, the thickness h of the engaging portion 15' is made not larger than f, which is the gap between the supporting shaft 16 and the upper regulating portion 54, so that the engaging portion 15' is insertable. Further, the drop-in amount e of the supporting shaft 16 in the hole 37 is made larger than (f–h), which is the gap play between the supporting shaft 16 and the upper regulating portion 54 when the engaging portion 15 is inserted, so that disengagement (disconnection) of the supporting shaft 16 from the hole 37 is prevented.

Figure 6:
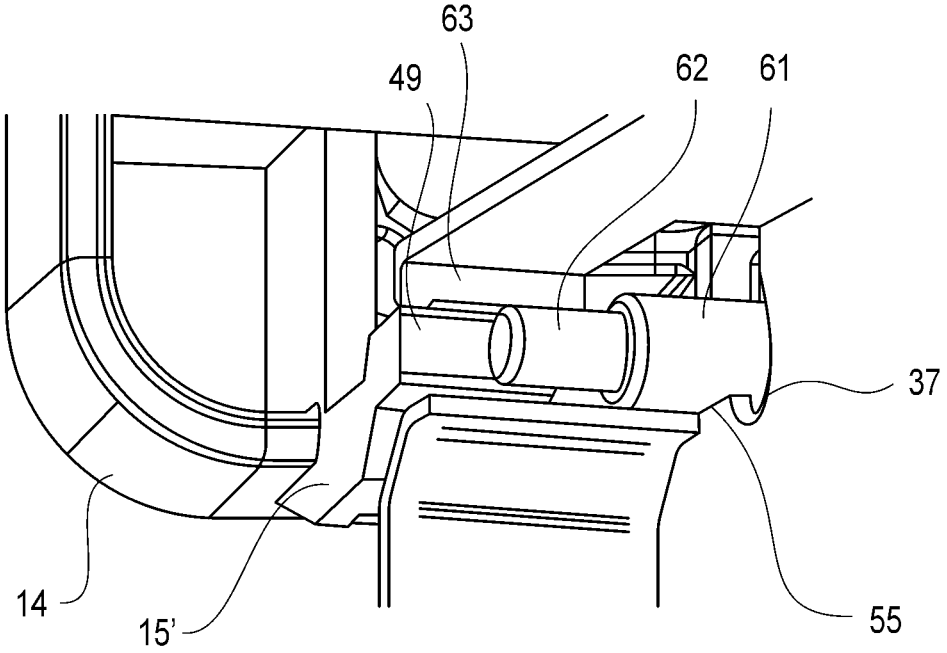
FIG. 6 is a partly enlarged perspective view for illustrating a longitudinal end portion of the fixing unit in the Second Embodiment.

With reference to FIG. 6, the positional relationship of the above-described mounting portions with respect to a depth direction (longitudinal direction of the fixing unit) will be described. FIG. 6 shows the positional relationship, among the engaging portion 15', the supporting shaft 16 and the apparatus main assembly side plate 44, which corresponds to that shown in FIG. 5B. The supporting shaft 16 includes a large shaft portion 61 having a large diameter and a small shaft portion 62 having a diameter smaller than the diameter of the large shaft portion 61. The large shaft portion 61 contacts the hole 37 from the lower regulating portion 55 of the side plate 44 and receives a load when the fixing unit 72 is mounted in and held by the apparatus main assembly 70A.

Further, the small shaft portion 62 receives a pressing force from the free end portion 49 of the engaging portion 15'. The free end portion 49 of the engaging portion 15' and the free end 63 of the upper regulating portion of the side plate 44 are in such a positional relationship that the free end portion 49 projects so that the pressing force by the free end portion 49 acts on only the small shaft portion 62 side (the left side in FIG. 6) and does not act on the large shaft portion 61. For that reason, the large shaft portion 61, which is thick at a base portion of the fixing unit, holds a load of the fixing unit and a force due to the driving, so that motion, such as vibration of the fixing unit due to flexure of the shaft, is prevented. Further, the free end portion is decreased in diameter, so that the remaining space can be used as a space when the engaging portion 15' moves onto the supporting shaft 16, and thus is effective in downsizing the apparatus.

As described above, when the fixing unit is mounted in the apparatus main assembly, the operator grips the handle 14 for holding the fixing unit 72 and then mounts the supporting shaft 16 in the hole 37 of the lower regulating portion 55. After the mounting, only by pushing (rotating) the handle 14 as it is, can the fixing unit 72 be fixed to and held by the apparatus main assembly 70A. At this time, the reaction force, such as a spring force, is not exerted on the fixing unit 72, and therefore the fixing unit 72 can be easily mounted.

The pushing (pressing) operation in the arrow 64 direction shown in of FIG. 5A is not limited to the case where the user (operator) directly pushed (presses) the handle 14. In an outside of the fixing unit 72, a cover for being opened and closed when the fixing unit 72 is mounted in and demounted from the apparatus main assembly or a movable guide is provided with a pressing portion opposing the handle 14, and then by pressing the handle 14 by a closing operation thereof, the fixing unit 72 is also mountable.

In the above-described embodiments, the supporting shaft 16 and the opening 56 are provided at each of the longitudinal end portions, but may also be provided at only one of the longitudinal end portions.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Application No. 2014-068578 filed on Mar. 28, 2014, which is hereby incorporated by reference herein in its entirety.

What is claimed is:

1. An image forming apparatus comprising:

a main assembly; and a fixing unit configured to fix an image on a recording material, wherein said fixing unit is detachably mountable to said main assembly, wherein said fixing unit includes a projected portion configured to regulate the position of said fixing unit relative to said main assembly, wherein said main assembly includes an opening configured to guide movement of the projected portion and a recessed portion, provided downstream of the opening with respect to a mounting direction of said fixing unit, configured to regulate the position of the projected portion, wherein said fixing unit includes an engaging portion engaging with the opening so that the projected portion is prevented from coming out of the opening after entering the recessed portion, wherein said fixing unit includes a handle configured to hold said fixing unit by a user, and the handle is foldable relative to said fixing unit, and wherein the engaging portion is provided on the handle.

2. An image forming apparatus according to claim 1, wherein when the handle is folded in a state in which said fixing unit is mounted in said main assembly, the engaging portion engages with the opening.

3. An image forming apparatus according to claim 1, wherein the engaging portion is inserted to a position where the engaging portion goes over the projected portion entering the recessed portion.

4. An image forming apparatus according to claim 3, wherein a stepped portion between the opening and the recessed portion is larger than a gap between the projected portion and the opening.

5. An image forming apparatus according to claim 1, wherein with respect to a longitudinal direction of said fixing unit, the projected portion is provided at each of end portions of said fixing unit, and the recessed portion is also provided correspondingly to an associated one of the projected portions.

6. An image forming apparatus comprising:

a main assembly; and a fixing unit configured to fix an image on a recording material, wherein said fixing unit is detachably mountable to said main assembly, wherein said fixing unit includes a projected portion configured to regulate the position of said fixing unit relative to said main assembly, wherein said main assembly includes an opening configured to guide movement of the projected portion and a recessed portion, provided downstream of the opening with respect to a mounting direction of said fixing unit, configured to regulate the position of the projected portion, wherein said fixing unit includes an engaging portion engaging with the opening so that the projected portion is prevented from coming out of the opening after entering the recessed portion, and wherein the engaging portion is inserted to a position where the engaging portion goes over the projected portion entering the recessed portion.

* * * * *